United States Patent [19]

Mahrus et al.

[11] Patent Number: 4,735,128

[45] Date of Patent: Apr. 5, 1988

[54] PISTON

[75] Inventors: Duraid Mahrus; Alexandre Afonso, both of Sao Paulo, Brazil

[73] Assignee: Metal Leve S/A Industria e Comercio, Brazil

[21] Appl. No.: 826,201

[22] Filed: Feb. 5, 1986

[30] Foreign Application Priority Data

Feb. 7, 1985 [BR] Brazil ..... 8500556

[51] Int. Cl.[4] ..... F02F 3/06

[52] U.S. Cl. ..... 92/212; 29/156.5 R; 92/213; 92/223; 92/224; 92/228; 123/193 P

[58] Field of Search ..... 92/213, 212, 222, 223, 92/224, 228, 248; 123/193 P; 29/156.5 R

[56] References Cited

U.S. PATENT DOCUMENTS

| | | | |
|---|---|---|---|
| 4,254,621 | 3/1981 | Nagumo | 123/193 P |
| 4,334,507 | 6/1982 | Kohnert et al. | 92/213 X |
| 4,495,684 | 1/1985 | Sander et al. | 92/213 X |
| 4,523,554 | 6/1985 | Ryu | 123/193 C |
| 4,530,884 | 7/1985 | Erickson et al. | 123/193 P |
| 4,599,772 | 7/1986 | Graham | 92/213 X |

*Primary Examiner*—Edward K. Look

*Attorney, Agent, or Firm*—Darby & Darby

[57] ABSTRACT

A piston for internal combustion engines made of a light alloy and comprising a skirt portion and a head portion, having a ceramic insert adapted on the head portion and connected to same by mechanical locking. The ceramic insert is provided with pores at least on the portion engaging the piston head. The pores have a size which enable them to be filled with the light alloy during the manufacture of the piston by the squeeze casting method.

19 Claims, 1 Drawing Sheet

PISTON

The present invention relates to a method for manufacturing an internal combustion engine piston as well as the piston obtained thereby. More particularly, the invention is concerned with a piston of light metal, preferably aluminum or an aluminum-based alloy, which top portion is provided with a ceramic insert.

The current stage of development of internal combustion engines and the foreseeable trends are directed to high output engines, which translates into increasingly severe demands on several engine components. This is particularly true as regards turbocharged diesel engines where thermal and mechanical loads on the piston crown reach amounts which make this area extremely susceptible to cracks and even fracture.

To overcome these problems the prior art proposes several solutions, the most recent of which include the application of reinforcing materials to the critical area such as inserts of ferrous metals, fibers and particularly ceramics. Concerning ceramics, there are known several manners of applying same to automotive components including engine pistons. The U.S. Pat. No. 4,245,611, to Harry R. Mitchell et al., granted Jan. 20, 1981, describes a method for the manufacture of a piston wherein the crown central portion defining the combustion chamber is in the form of a ceramic insert having an inverted conical shape thereby causing the insert to be locked in the piston. The excessive stresses in both the ceramic insert and the light alloy piston are absorbed by a layer of fibrous material provided between the insert and the piston.

The European patent application No. LPO-82108729.3 by Tadashi Donomoto et al., filed Sept. 21, 1982, discloses another solution. According to said application the light alloy of which the piston is made is first bonded to a composite layer made up of inorganic or metallic fibers and the light alloy. A layer of heat resistant alloy is then applied onto the composite layer. Finally, a layer of ceramic material is applied onto the layer of heat resistant alloy.

These proposals contained in said patents as well as other similar approaches known by those skilled in the art include the adoption of an intermediate layer between the piston material and the ceramic, in view of the difference of coefficient of thermal expansion between these dissimilar materials.

It is therefore an overall object of the present invention to provide a piston which crown is provided with a ceramic insert designed to increase the thermal and mechanical resistance of the crown portion.

It is a further and more specific object of this invention to provide a piston which crown portion in the form of a ceramic insert is directly connected to the piston by mechanical anchorage.

It is still an object of the present invention to provide a method to perform the mechanical connection between the ceramic insert and the piston.

According to the invention, the mechanical connection between the piston and the ceramic insert is accomplished by filling pores provided in the ceramic portion with the piston material, the said anchorage being effected by the squeeze casting method. According to the invention, there is provided a ceramic part which lower and upper surfaces are porous, the pores of the lower surface, i.e., that which is in contact with the piston, being larger (from about 20 to 40 pm) than the pores of the upper surface, i.e., that which is the top of the piston, the upper surface pores measuring from about 1 to 10 pm.

The invention will be hereinafter described with reference to the accompanying drawings wherein.

Figure 1:
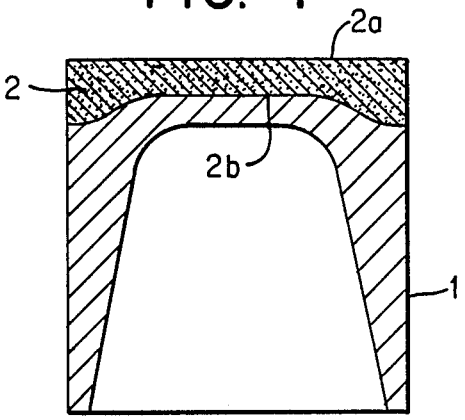
FIG. 1 is a longitudinal sectional view of a piston having a ceramic insert on its crown portion.
Figure 2:
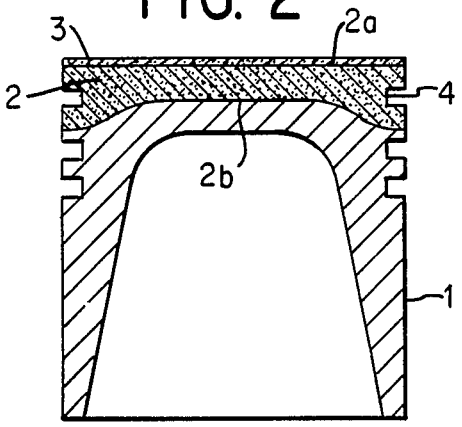
FIG. 2 is a longitudinal sectional view of the piston depicted in FIG. 1, showing a ring groove formed in the insert and an overlay on the insert upper face.
Figure 3:
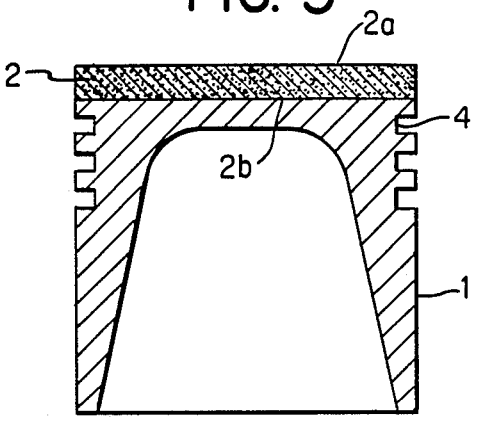
FIG. 3 is a longitudinal sectional view of an alternate shape of the piston of FIG. 1, in which the insert height is uniform.
Figure 4:
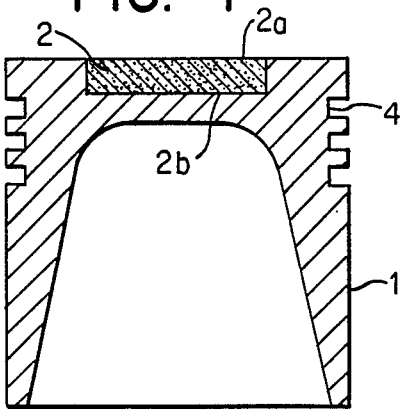
FIG. 4 is a longitudinal sectional view of another alternative design of the piston of FIG. 1, in which the insert constitutes the central portion of the piston crown, i.e., the portion defining the combustion chamber.

According to one embodiment of the invention, shown in FIG. 1 and 2, a squeeze casting die is heated up to a temperature between 200° and 400° C., and the porous ceramic insert (2) is heated up to a temperature between 400° and 600° C. The insert (2) is then placed on the bottom of the die with its upper surface (2*a*) facing downward. Thereafter, a certain amount of molten aluminum alloy is poured into the die. Then, a punch having a shape corresponding to the contour of the inside of the piston is introduced into the die, at first without applying a pressure other than that resulting from the punch own weight. At the time of beginning of solidification of the aluminum alloy and as it takes place, a progressive pressure is applied on the punch so as to cause the alloy to be squeezed between the punch and the die wall and against the lower face (2*b*) of insert (2), thereby defining the shape of piston (1) and causing the alloy to fill the pores in the ceramic insert (2).

After the solidification of the aluminum alloy, the piston (1) having the insert (2) as an integral part is removed from the die by suitable means and is then machined to its final dimensions. In the configuration of the insert shown in FIG. 1 and 2, the insert portion next to the peripheral annular region is higher than the central portion, thus enabling a groove to be machined in the peripheral annular region to accommodate the upper compression ring, as shown in FIG. 2. For certain applications where temperatures at the combustion area are extremely high it may be desirable to cover the top of insert (2) with a layer (3), for instance, of chrome oxide, in order to provide the piston top with an additional thermal resistance. This optional layer is depicted in FIG. 2 and can be applied by known methods such as diffusion, plasma spraying or immersion.

We claim:

1. A method for manufacturing an internal combustion engine piston made of a light alloy and comprising a skirt portion and a head portion on which a ceramic insert is mounted, the method comprising the steps of:

obtaining a ceramic insert having an upper face and a predetermined porosity at least on its lower portion, said predetermined porosity being such that the pores are dimensioned to enable the penetration and subsequent solidification of the light alloy of which the piston is made into at least part of the height of the ceramic insert, said upper portion of said ceramic insert having a second predetermined porosity which is substantially less than said first predetermined porosity;

heating the ceramic insert to a temperature between about 400° to 600° C.;

heating a casting die to a temperature between about 200° to 400° C.;

placing the ceramic insert on the bottom of the die, the upper surface of the ceramic insert facing the bottom of the die;

lowering a punch into the die and apply a progressive pressure to the punch so as to form the piston and cause the light metal to fill the pores of the ceramic insert;

removing the piston from the die after solidification of the light alloy; and machining the piston to its final dimension.

2. A method as defined in claim 1, wherein the diameters of the ceramic insert and of the piston head portion are substantially the same.

3. A method as defined in claim 2, wherein the ceramic insert is provided with at least one peripheral annular groove to accommodate a piston ring.

4. A method as defined in claim 3, wherein a ceramic layer of high heat resistance is applied to the upper face of the ceramic insert.

5. A method as defined in claim 2, wherein a ceramic layer of high heat resistance is applied to the upper face of the ceramic insert.

6. A method as defined in claim 1, wherein a ceramic layer of high heat resistance is applied to the upper face of the ceramic insert.

7. A method as defined in claim 6, wherein the ceramic layer is applied by a diffusion, plasma spraying or immersion process.

8. A piston for internal combustion engines, made of a light alloy and including a skirt portion and a head portion on which a ceramic insert is mounted, wherein said ceramic insert has a predetermined porosity at least on its lower portion, said predetermined porosity being such that the pores are dimensioned to enable the penetration and subsequent solidification of the light alloy of which the piston is made into at least part of the height of the ceramic insert, said upper portion of said ceramic insert having a second predetermined porosity which is substantially less than said first predetermined porosity.

9. The piston as claimd in claim 8, wherein the top of insert is provided with a ceramic layer.

10. A piston for internal combustion engines, made of a light alloy and including a skirt portion and a head portion on which a ceramic insert is mounted, said ceramic insert having a predetermined porosity at least in its lower portion, said predetermined porosity being such that the pores are dimensioned to enable the penetration and subsequent solidification of the light alloy of the piston into at least part of the height of the ceramic insert, the pores of the ceramic insert tapering from the lower portion toward the upper portion of the ceramic insert.

11. The piston as claimed in claim 10, wherein the size of the pores of insert is 20 to 40 pm on the lower portion and 1 to 10 pm on the upper portion.

12. The piston as claimed in claim 11, wherein the top of insert is provided with a ceramic layer.

13. The piston is claimed in claim 10, wherein the ceramic insert has an annular configuration and is in coaxial arrangement with the piston.

14. The piston as claimed in claim 13, wherein the diameter of the ceramic insert is substantially the same as that of the head portion of piston, and the ceramic insert is provided with at least one peripheral annular groove for a piston ring.

15. The piston is claimed in claims 14, wherein the height of the peripheral portion of the ceramic insert is greater than the height of the central portion.

16. The piston as claimed in claim 15, wherein the height of the peripheral portion of the ceramic insert is greater than the height of the central portion.

17. The piston as claimed in claim 14, wherein the top of insert is provided with a ceramic layer.

18. The piston as claimed in claim 13, wherein the top of insert is provided with a ceramic layer.

19. The piston as claimed in claim 10, wherein the top of insert is provided with a ceramic layer.

* * * * *